US010023417B2

(12) United States Patent
Shibata et al.

(10) Patent No.: US 10,023,417 B2
(45) Date of Patent: Jul. 17, 2018

(54) SHEET POST-PROCESSING APPARATUS AND IMAGE FORMING SYSTEM

(71) Applicants: Hidefumi Shibata, Kanagawa (JP); Masanobu Kimata, Kanagawa (JP); Masaaki Kawasaki, Kanagawa (JP); Ryohei Morisaki, Kanagawa (JP); Norihiko Murakami, Kanagawa (JP); Maki Nishide, Kanagawa (JP)

(72) Inventors: Hidefumi Shibata, Kanagawa (JP); Masanobu Kimata, Kanagawa (JP); Masaaki Kawasaki, Kanagawa (JP); Ryohei Morisaki, Kanagawa (JP); Norihiko Murakami, Kanagawa (JP); Maki Nishide, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/170,310

(22) Filed: Jun. 1, 2016

(65) Prior Publication Data

US 2016/0355364 A1 Dec. 8, 2016

(30) Foreign Application Priority Data

Jun. 3, 2015 (JP) ..... 2015-113136

(51) Int. Cl.
*B65H 31/02* (2006.01)
*B65H 31/30* (2006.01)
(Continued)

(52) U.S. Cl.
CPC ..... *B65H 31/02* (2013.01); *B65H 31/3027* (2013.01); *B65H 31/36* (2013.01);
(Continued)

(58) Field of Classification Search
CPC ..... B65H 31/36; B65H 2801/27; B65H 2511/152; B65H 2513/108; B65H 2511/17
See application file for complete search history.

(56) References Cited

U.S. PATENT DOCUMENTS

| | | | | |
|---|---|---|---|---|
| 7,874,553 | B2 | 1/2011 | Kushida et al. | |
| 7,891,652 | B2 * | 2/2011 | Mandel | B41J 13/0009 270/58.02 |
| 8,439,342 | B2 * | 5/2013 | Okamoto | B65H 31/3027 270/58.08 |
| 8,632,067 | B2 * | 1/2014 | Awano | B65H 31/02 270/58.09 |
| 8,720,880 | B2 * | 5/2014 | Awano | B65H 31/38 270/58.07 |

(Continued)

FOREIGN PATENT DOCUMENTS

| | | |
|---|---|---|
| JP | 11-060026 | 3/1999 |
| JP | 2007-153454 | 6/2007 |

(Continued)

*Primary Examiner* — Jeremy R Severson
(74) *Attorney, Agent, or Firm* — Harness, Dickey & Pierce, P.L.C.

(57) ABSTRACT

A sheet post-processing apparatus includes: a sheet stack tray; a rear-end-position regulating member, against which a rear end of the sheet on the tray is butted to align a position of the sheet in a sheet conveying direction to the stack tray, the rear end of the sheet being a rear end in the conveying direction; and a roller member that comes in contact with an upper surface of the sheet conveyed to an upper side of the tray, before the sheet is stacked on a stacking surface on the tray, and conveys the sheet stacked on the stacking surface toward the rear-end-position regulating member, wherein a rotation speed before stacking is set to be smaller than a rotation speed after stacking, and the rotation speed of before stacking is greater than zero.

18 Claims, 12 Drawing Sheets

(51) Int. Cl.

| | |
|---|---|
| ***B65H 31/36*** | (2006.01) |
| ***B65H 31/38*** | (2006.01) |
| ***G03G 15/00*** | (2006.01) |

(52) U.S. Cl.

CPC ..... *B65H 31/38* (2013.01); *G03G 15/6541* (2013.01); *G03G 15/6582* (2013.01); *B65H 2301/4212* (2013.01); *B65H 2301/4213* (2013.01); *B65H 2403/942* (2013.01); *B65H 2404/1521* (2013.01); *B65H 2404/723* (2013.01); *B65H 2405/11151* (2013.01); *B65H 2511/13* (2013.01); *B65H 2511/152* (2013.01); *B65H 2511/17* (2013.01); *B65H 2511/30* (2013.01); *B65H 2513/108* (2013.01); *B65H 2513/11* (2013.01); *B65H 2513/53* (2013.01); *B65H 2553/612* (2013.01); *B65H 2801/27* (2013.01); *G03G 2215/00822* (2013.01)

(56) References Cited

U.S. PATENT DOCUMENTS

| | | | | |
|---|---|---|---|---|
| 2009/0062100 | A1 | 3/2009 | Takekawa et al. | |
| 2010/0252981 | A1 | 10/2010 | Kimata et al. | |
| 2011/0190109 | A1 | 8/2011 | Kimata | |
| 2011/0221125 | A1 | 9/2011 | Kimata | |
| 2013/0134645 | A1* | 5/2013 | Kato ..... | B65H 31/00 270/58.07 |
| 2013/0270761 | A1 | 10/2013 | Kimata | |
| 2015/0329308 | A1 | 11/2015 | Iwata et al. | |
| 2015/0329309 | A1 | 11/2015 | Iwata et al. | |

FOREIGN PATENT DOCUMENTS

| | | |
|---|---|---|
| JP | 2009-227468 | 10/2009 |
| JP | 2013-189272 | 9/2013 |

* cited by examiner

SHEET POST-PROCESSING APPARATUS AND IMAGE FORMING SYSTEM

CROSS-REFERENCE TO RELATED APPLICATIONS

The present application claims priority under 35 U.S.C. § 119 to Japanese Patent Application No. 2015-113136 filed in Japan on Jun. 3, 2015. The contents of which are incorporated herein by reference in their entirety.

BACKGROUND OF THE INVENTION

1. Field of the Invention

The present invention relates to a sheet post-processing apparatus and an image forming system.

2. Description of the Related Art

For example, there is a known sheet post-processing apparatus that temporarily stacks, on a stack tray, sheets conveyed from an image forming apparatus, performs a binding process on a sheet bundle that is a stack of a predetermined number of sheets, and then discharges the sheet bundle.

A sheet conveyed onto the stack tray comes in contact with a roller member that rotates in a direction in which the sheet is fed back toward an upstream side in a conveying direction, so that the motion of the sheet is damped and the sheet falls onto the stack tray. Subsequently, the sheet is conveyed to the upstream side in the conveying direction on the stack tray by the roller member and a rear end of the sheet butts against a rear-end-position regulating member, so that the sheet is aligned in the conveying direction.

The rotation speed of the roller member is constant without a change between when the sheet falls and when the sheet is conveyed to the rear-end-position regulating member.

Japanese Patent Laid-open Publication No. 2009-227468 discloses a technology, in which the speed of a rotation member for conveying a sheet to a rear-end-position regulating member is reduced relative to the rotation speed of a roller member for causing a sheet to fall onto a stack tray, in order to prevent buckling that occurs when the sheet is excessively conveyed backward.

The state of a sheet that is falling onto a stacking surface of the stack tray is unstable in the air. Therefore, if a conveying force is applied to the sheet by the roller member, a landing position of the sheet fluctuates.

If the rear end of the landed sheet is too close to the rear-end-position regulating member, the sheet is excessively conveyed at the time of rear-end butting, and sheet buckling occurs.

In contrast, if the rear end of the landed sheet is too far from the rear-end-position regulating member, the rear end of the sheet may not be conveyed to the rear-end-position regulating member, and a binding failure may occur.

In Japanese Patent Laid-open Publication No. 2009-227468, the influence of the roller member while the sheet is falling onto the stack tray is not considered.

In view of the above circumstances, there is a need to provide a sheet post-processing apparatus capable of stabilizing a landing state of a sheet on a stack tray, and contributing to sheet alignment accuracy and post-processing accuracy.

SUMMARY OF THE INVENTION

It is an object of the present invention to at least partially solve the problems in the conventional technology.

According to exemplary embodiments of the present invention, there is provided a sheet post-processing apparatus comprising: a stack tray for stacking a sheet; a rear-end-position regulating member, against which a rear end of the sheet stacked on the stack tray is butted to align a position of the sheet in a conveying direction in which the sheet is conveyed toward the stack tray, the rear end of the sheet being a rear end in the conveying direction; and a roller member that comes in contact with an upper surface of a sheet conveyed to an upper side of the stack tray, before the sheet is stacked on a stacking surface on the stack tray, and conveys the sheet stacked on the stacking surface toward the rear-end-position regulating member, wherein a rotation speed before stacking, which is a rotation speed of the roller member when the roller member is in contact with the sheet while the rear end of the sheet in the conveying direction is not landed on the stacking surface, is set to be smaller than a rotation speed after stacking, which is a rotation speed of the roller member when the roller member conveys the sheet to the rear-end-position regulating member while the sheet is stacked on the stacking surface, and the rotation speed of before stacking is greater than zero.

Exemplary embodiments of the present invention also provide an image forming system comprising: an image forming apparatus that forms an image on a sheet based on image information; and a sheet post-processing apparatus, wherein the sheet post-processing apparatus comprises; a stack tray for stacking the sheet; a rear-end-position regulating member, against which a rear end of the sheet stacked on the stack tray is butted to align a position of the sheet in a conveying direction in which the sheet is conveyed toward the stack tray, the rear end of the sheet being a rear end in the conveying direction; and a roller member that comes in contact with an upper surface of the sheet conveyed to an upper side of the stack tray, before the sheet is stacked on a stacking surface on the stack tray, and conveys the sheet stacked on the stacking surface toward the rear-end-position regulating member, wherein a rotation speed before stacking, which is a rotation speed of the roller member when the roller member is in contact with the sheet while the rear end of the sheet in the conveying direction is not landed on the stacking surface, is set to be smaller than a rotation speed after stacking, which is a rotation speed of the roller member when the roller member conveys the sheet to the rear-end-position regulating member while the sheet is stacked on the stacking surface, and the rotation speed of before stacking is greater than zero.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
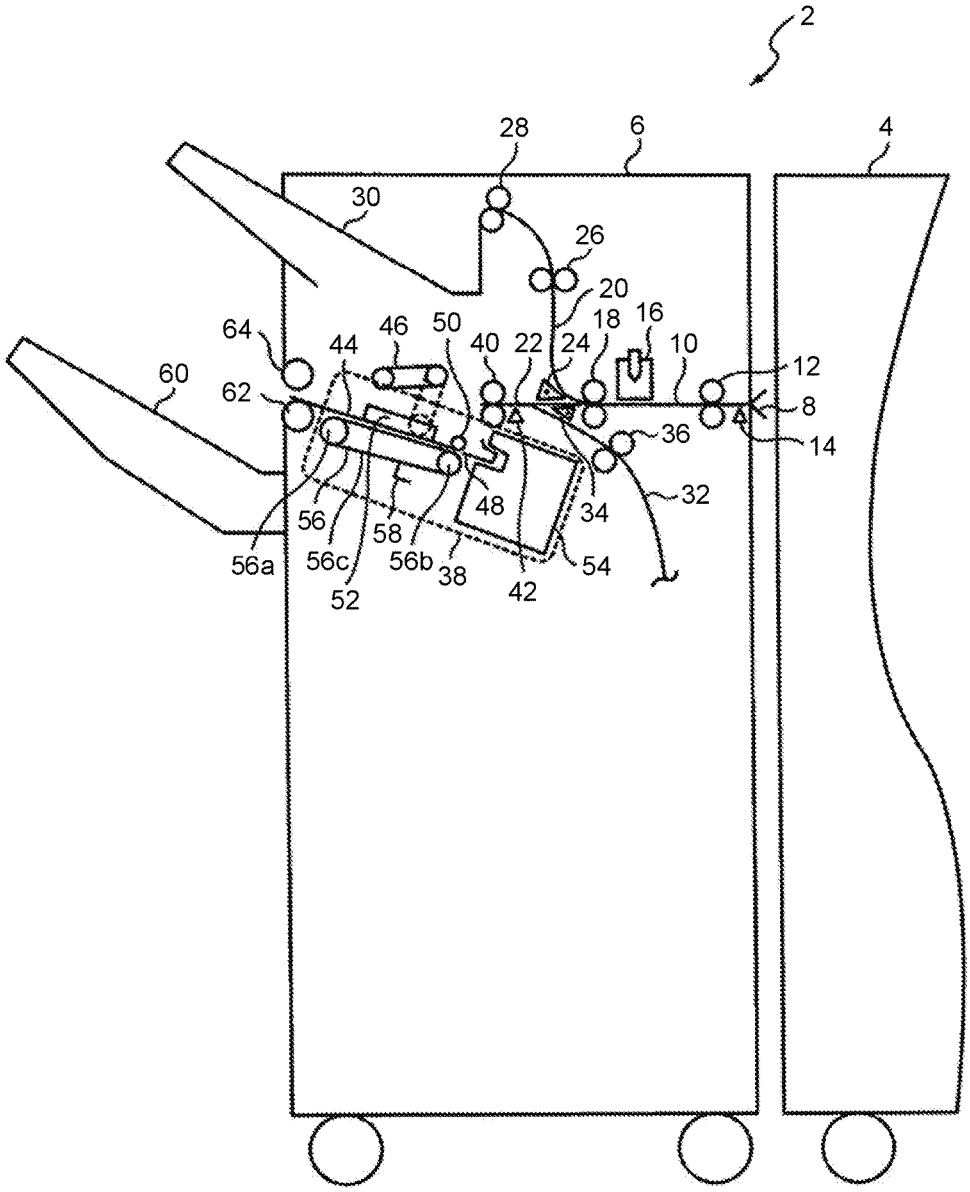
FIG. 1 is a schematic configuration diagram of an image forming system according to a first embodiment of the present invention.

Exemplary embodiments of the present invention will be described below with reference to the drawings.

FIG. 1 to FIG. 7B illustrate a first embodiment.

An overview of a configuration of an image forming system according to the first embodiment will be described based on FIG. 1. An image forming system 2 includes an image forming apparatus 4 and a sheet post-processing apparatus 6 that is arranged on a sheet discharge side of the image forming apparatus 4.

The image forming apparatus 4 is a conventionally-known electrophotography image forming apparatus, and is configured to form an electrostatic latent image based on image information on an image bearer by an exposing unit, develop the electrostatic latent image by a developing unit, eventually transfer the developed toner image to a recording medium (hereinafter, referred to as a sheet or paper), and fix the image by a fixing unit.

The sheet post-processing apparatus 6 may be integrated with the image forming apparatus 4 or may be detachably connected to the image forming apparatus 4.

An image-formed sheet discharged from the image forming apparatus 4 enters a first conveying path 10 of the sheet post-processing apparatus 6 through a connection port 8. On the first conveying path 10, an entrance roller pair 12 and an entrance sensor 14 are arranged, and the entrance sensor 14 detects that a sheet is conveyed into the sheet post-processing apparatus 6.

On the downstream side of the entrance roller pair 12, a punching unit 16 that punches a hole in the sheet is arranged. On the downstream side of the punching unit 16, a conveying roller pair 18 is arranged.

The downstream side of the conveying roller pair 18 is bifurcated into a second conveying path 20 extending upward and a third conveying path 22 as an extended path of the first conveying path 10.

In a bifurcation area of the second conveying path 20 and the third conveying path 22, a first bifurcating claw 24 is provided. By controlling rotation of the first bifurcating claw 24, a sheet is selectively guided to one of the conveying paths.

The sheet guided to the second conveying path 20 is conveyed by a conveying roller pair 26, and discharged to a proof tray 30 by a paper ejection roller pair 28.

A fourth conveying path 32 is branched from the third conveying path 22. By controlling rotation of a second bifurcating claw 34, a sheet is selectively guided to the fourth conveying path 32. The sheet guided to the fourth conveying path 32 is conveyed by a pre-stack roller pair 36.

On the third conveying path 22, an intermediate conveying roller pair 40 for conveying a sheet to an end binding unit 38 is arranged. In the vicinity of the upstream side of the intermediate conveying roller pair 40, an intermediate conveying sensor 42 that detects a sheet is arranged.

The sheet is ejected on a staple tray 44, which is a stack tray, by the intermediate conveying roller pair 40. A tapping roller 46 as a roller member is arranged above the staple tray 44. A rear end stopper 48 as a rear-end-position regulating member is arranged on the upstream side of the staple tray 44 in a sheet conveying direction.

The tapping roller 46 as one of aligning members performs a pendulum motion to thereby come in contact with a sheet, drop the sheet onto the staple tray 44 with high landing accuracy, and convey the sheet toward the rear end stopper 48.

A rear end of the sheet conveyed by the tapping roller 46 is butted against the rear end stopper 48 by a returning roller 50 as a butting member that is another one of the aligning members, so that the position of a sheet bundle in the conveying direction is aligned. The returning roller 50 is capable of coming in contact with and away from a stacking surface.

The rear end of the sheet means a rear end of a sheet in the conveying direction when the sheet is conveyed toward the staple tray 44.

On the staple tray 44, a pair of jogger fences 52 is provided. The jogger fences 52 move back and forth in a sheet width direction (lateral direction) perpendicular to the sheet conveying direction and align the position of a sheet ejected on the staple tray 44 in the sheet width direction.

Through the above-described two operations, sheets ejected on the staple tray 44 are stacked in an aligned manner. As for the aligned sheet bundle, in a staple mode, an end binding stapler 54 moves in the sheet width direction and binds an appropriate portion in a lower edge area of the aligned sheet bundle.

The sheet bundle (paper bundle) subjected to a binding process is discharged onto a paper ejection tray 60 by a discharging claw 58 that is moved by a belt conveying unit 56. The belt conveying unit 56 includes supporting rollers 56*a* and 56*b* and a belt 56*c*.

When the sheet bundle is discharged, the sheet bundle is stably discharged by being sandwiched by a paper ejection roller 62 and a driven roller 64.

With reference to FIGS. 2 to 5, a sheet stack operation in the staple mode will be described.

Figure 2:
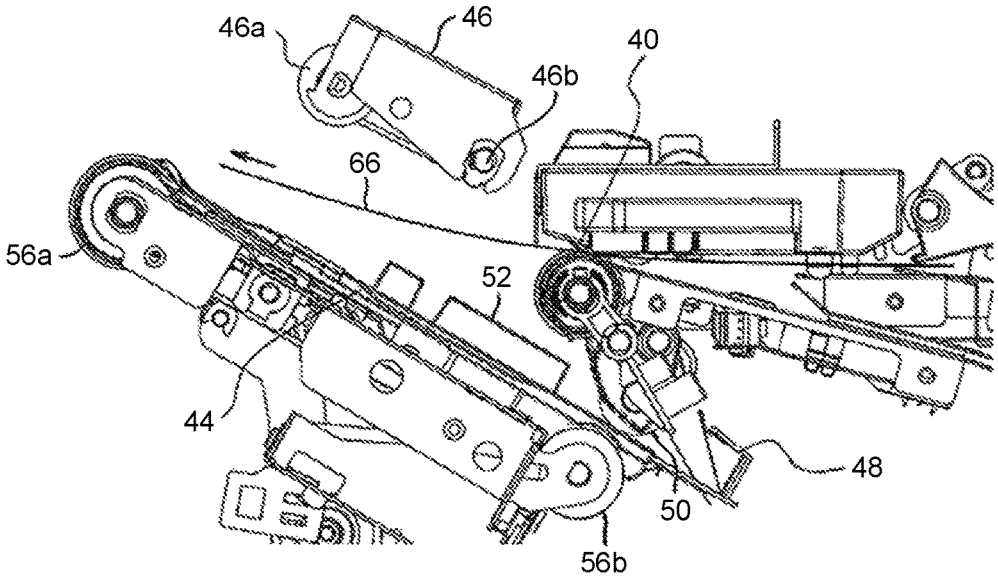
FIG. 2 is a diagram illustrating main parts in a state in which a sheet is conveyed to a staple tray.

As illustrated in FIG. 2, the tapping roller 46 includes a rotation roller 46*a* and can rotate in a vertical direction by using a shaft 46*b* as a fulcrum. Rotation of the rotation roller 46*a* is arbitrarily controlled.

An image-formed sheet 66 conveyed from the image forming apparatus 4 passes through the intermediate conveying roller pair 40 and is conveyed to the upper side of the staple tray 44.

At a timing at which the intermediate conveying sensor 42 detects a rear end of the sheet 66, the tapping roller 46 starts to perform a tapping operation.

Figure 3:
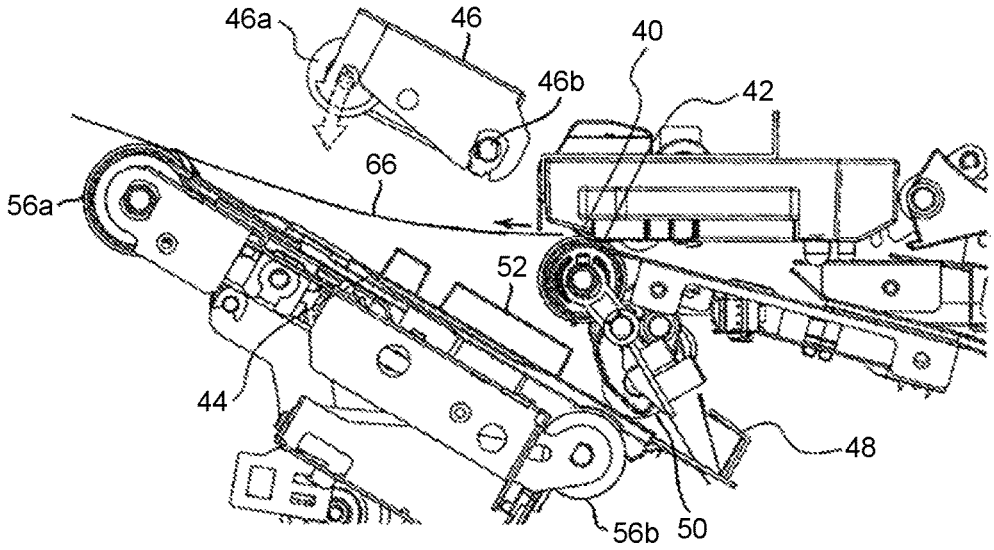
FIG. 3 is a diagram illustrating the main parts in a state in which a tapping roller starts to rotate from the state illustrated in FIG. 2.

That is, as illustrated in FIG. 3, the tapping roller 46 rotates downward toward the stacking surface of the staple tray 44 while the rotation roller 46*a* is in a non-rotating state.

The stacking surface indicates a stacking surface of the staple tray 44 when a sheet is not present on the staple tray 44, and indicates a surface of the topmost sheet when sheets are present on the staple tray 44.

Figure 4:
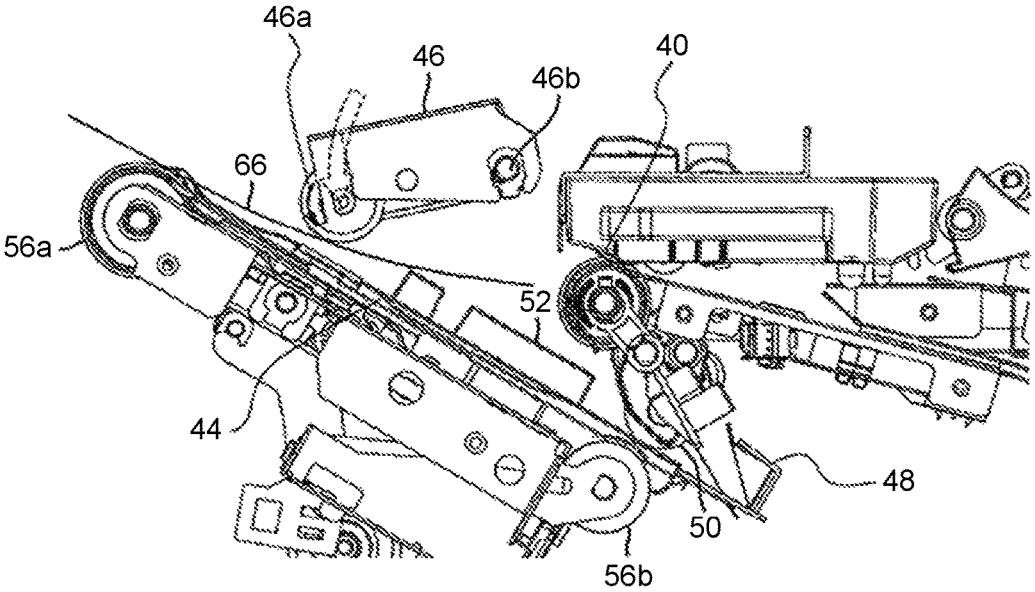
FIG. 4 is a diagram illustrating the main parts in a state in which a rotation roller of the tapping roller comes in contact with the sheet.

As illustrated in FIG. 4, the rotation roller 46*a* comes in contact with an upper surface of a sheet along with the rotation of the tapping roller 46. The rotation roller 46*a* comes in contact with the sheet 66 while the rotation roller 46*a* is in a non-rotating state, and then starts to rotate counterclockwise before coming in contact with the stacking surface of the staple tray 44 via the sheet 66.

Figure 5:
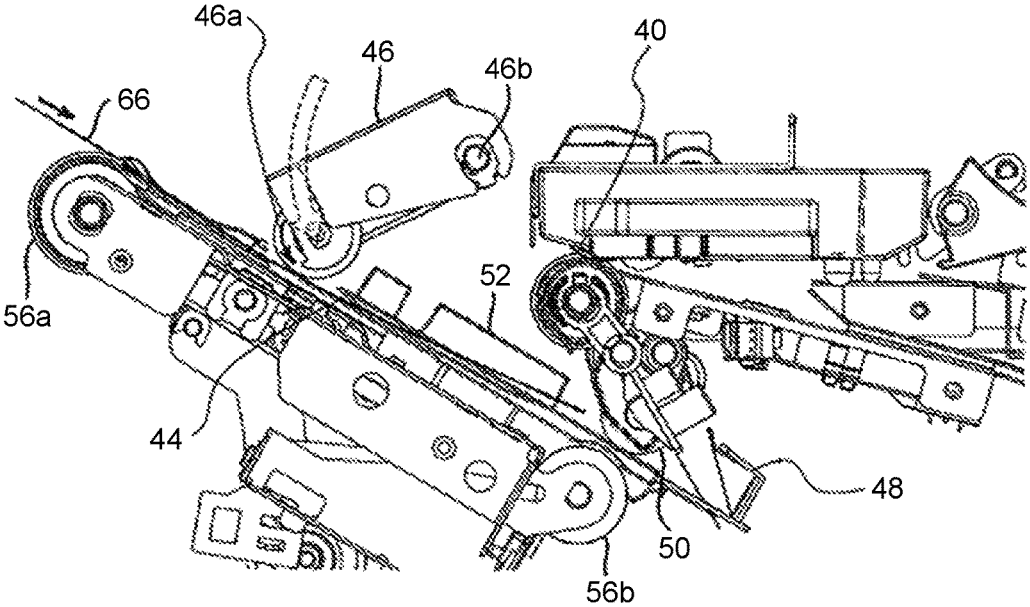
FIG. 5 is a diagram illustrating the main parts in a state in which the sheet is stacked on the staple tray and is conveyed toward a rear end stopper by the rotation roller.

As illustrated in FIG. 5, after the rotation roller 46*a* comes in contact with the stacking surface of the staple tray 44 via the sheet 66, that is, after the sheet 66 is stacked on the staple tray 44, the sheet 66 is conveyed toward the rear end stopper 48 by the rotation roller 46*a*.

The above-described stack operation will be described in detail below with reference to a timing diagram.

Figure 6:
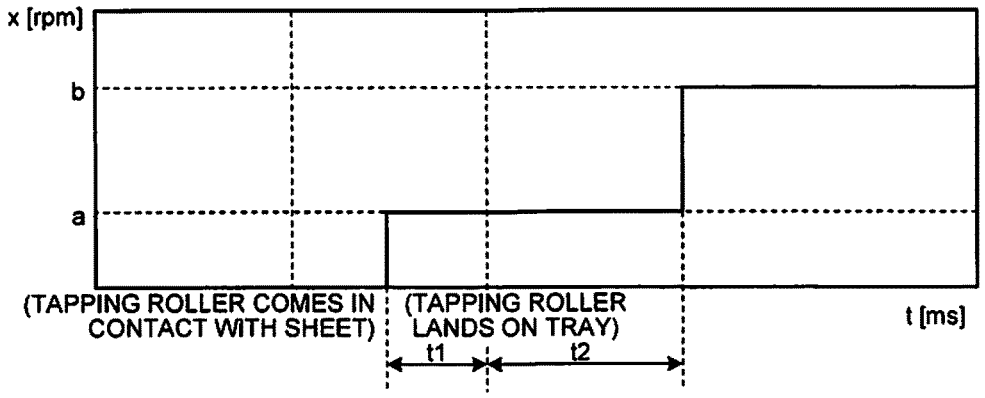
FIG. 6 is a timing diagram illustrating timings of setting a rotation speed of the rotation roller before stacking and a rotation speed of the rotation roller after stacking.

As illustrated in FIG. 6, after the rotation roller 46*a* comes in contact with the sheet 66, the rotation roller 46*a* is rotated at a rotation speed a rpm (revolutions per minute), which is a rotation speed before stacking, a predetermined time t1 ms (milliseconds) before the rotation roller 46*a* comes in contact with (lands on) the stacking surface of the staple tray 44 via the sheet 66.

The rotation speed before stacking is a rotation speed of the rotation roller 46*a* when the rotation roller 46*a* is in contact with a sheet while the rear end of the sheet in the conveying direction is not landed on the stacking surface.

After a predetermined time t2 (ms) since the landing of the rotation roller 46*a* on the staple tray 44 via the sheet 66, the rotation roller 46*a* is rotated at a rotation speed b (rpm), which is a rotation speed after stacking.

It is assumed that the rotation speed b (rpm) is a rotation speed with a conveying force to cause the rotation roller 46*a* to guide the sheet 66 to the rear end stopper 48.

It is also assumed that the rotation speed a is lower than the rotation speed b and has a value grater than 0 (rpm) in order to prevent a sheet from adhering to the stacking surface of the staple tray 44.

That is, the rotation speed a is a speed to apply, to the sheet 66 in an unstable state in the air above the staple tray 44, the minimum rotation force needed to prevent the sheet from adhering to the stacking surface. Consequently, it becomes possible to cause the sheet 66 to stably land on the staple tray 44.

Figure 7A:
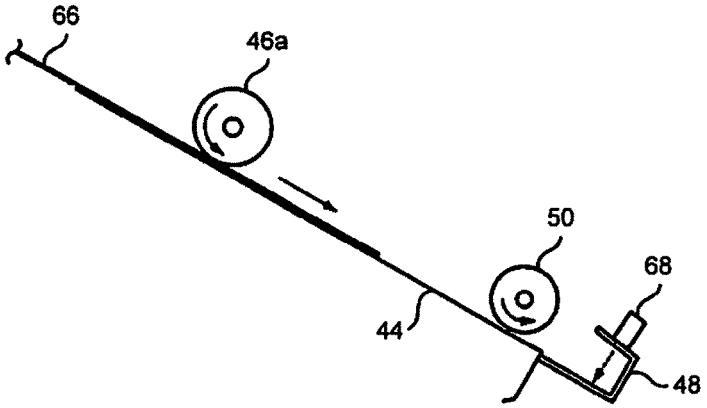
FIGS. 7A and 7B are diagrams illustrating an operation of aligning the rear end of a sheet on the staple tray.

As illustrated in FIG. 7A, the sheet 66 landed and stacked on the staple tray 44 is conveyed toward the rear end stopper 48 by the rotation roller 46*a* that rotates at the rotation speed b.

Figure 7B:
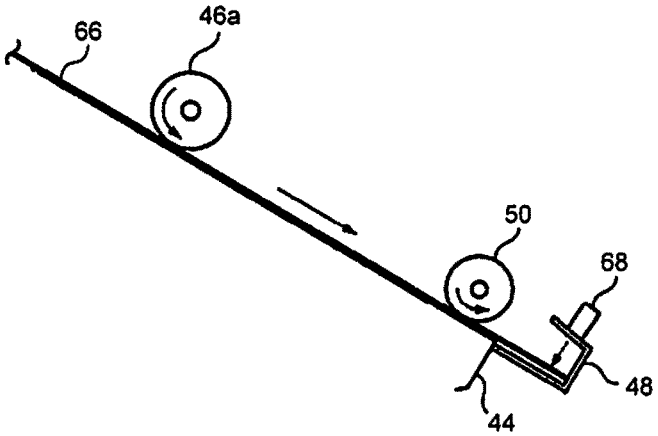

Subsequently, as illustrated in FIG. 7B, the sheet 66 butts against the rear end stopper 48 due to the conveyance by the rotation roller 46*a* and the returning roller 50, and the position of the sheet 66 in the conveying direction is aligned.

The above-described stack operation is repeated for each sheet conveyed by the intermediate conveying roller pair 40. Fluctuation of the landing position of the sheet on the staple tray 44 can be prevented because of the low rotation speed a of the rotation roller 46*a*, so that the accuracy of rear-end alignment by the contact with the rear end stopper 48 can be improved.

As a result, it is possible to improve alignment accuracy of a sheet bundle on the staple tray 44, enabling to improve post-processing accuracy.

The above-described stack operation is performed on the first sheet. When sheets are stacked on the staple tray 44, a timing at which the rotation roller 46*a* comes in contact with the stacking surface is changed. To prevent reduction in the accuracy caused by a change in the timing, at least one of the predetermined times t1 and t2 is changed for each number of stacked sheets. By doing so, it is possible to obtain the same alignment accuracy as the first sheet, with respect to the other sheets.

For the same purpose, it may be possible to change the predetermined times t1 and t2 depending on a sheet type (thickness or the like) that is set or detected.

Furthermore, it may be possible to provide a stack height detecting unit that detects a height of a stack of sheets on the staple tray 44, and change the predetermined times t1 and t2 based on detection information obtained from the stack height detecting unit. As the stack height detecting unit, for example, it may be possible to arrange a reflective optical sensor 68 on the upper surface of the rear end stopper 48 and detect a height of a stack that is changed depending on the number of stacked sheets.

As the stack height detecting unit, it may be possible to use a mechanical detecting unit, which is conventionally used to detect a height of a stack on a paper ejection tray.

Figure 8:
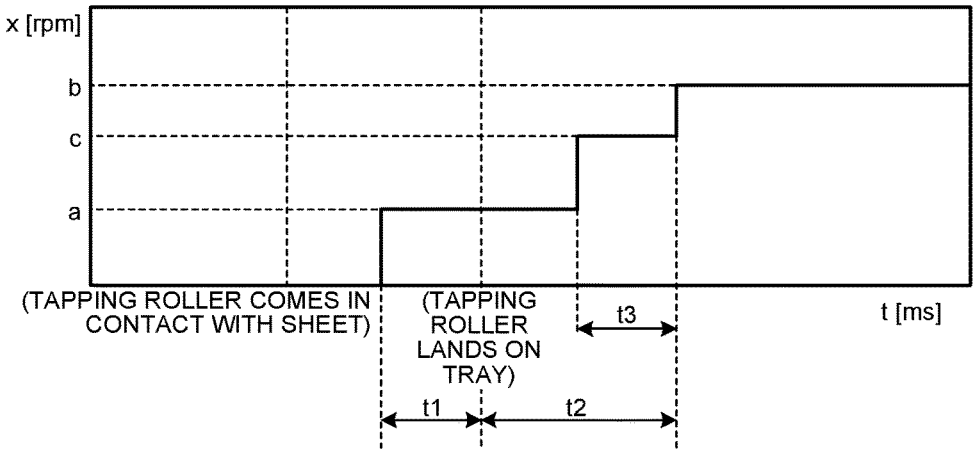
FIG. 8 is a timing diagram illustrating timings of setting a rotation speed of a rotation roller before stacking and a rotation speed of the rotation roller after stacking according to a second embodiment of the present invention.

FIG. 8 illustrates a second embodiment. The same components as those of the above-described first embodiment are denoted by the same symbols, the explanation of the same configurations and functions will be omitted, and only main parts will be described below (the same applies to the other embodiments to be described later).

If the low rotation speed a is rapidly changed to the high rotation speed b, a sheet surface may be damaged depending on a material of the sheet. The second embodiment is conceived to cope with this matter.

To cope with the above-described matter, in the second embodiment, the rotation speed of the rotation roller 46*a* is changed to a rotation speed c that is higher than the rotation speed a and lower than the rotation speed b for a predetermined time t3 before the end of the predetermined time t2.

Consequently, it is possible to increase the rotation speed of the rotation speed b in a stepwise manner, so that it is possible to reduce a gap that occurs when the rotation speed a is increased to the rotation speed b.

The rotation speed of the rotation roller 46*a* is not rapidly increased, so that it is possible to reduce the possibility that the sheet surface is damaged by contact with the rotation roller 46*a*.

FIG. 9A to FIG. 10B illustrate a third embodiment of the present invention.

The rotation speed b, as the rotation speed after stacking for conveyance toward the rear end stopper 48 by the tapping roller 46, is generally set to an optimal value based on sheet information. In reality, a user inputs information, such as a thickness or strength of a sheet, and the rotation speed b is automatically set based on the information.

When the information is manually input, it is cumbersome to set the input, and an input error may occur. If a type of a sheet to be actually used and the input information do not match each other, a sheet surface may be damaged or an alignment failure due to a conveyance failure may occur.

The third embodiment is conceived to cope with the above-described matters.

Figure 9A:
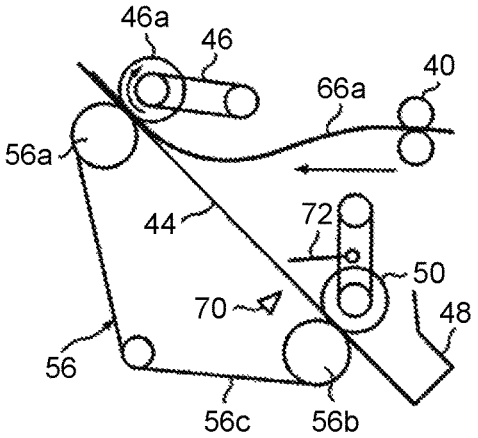
FIGS. 9A to 9F are diagrams illustrating a deflection detection operation and a rear end alignment operation according to a third embodiment of the present invention.

As illustrated in FIG. 9A, the rotation roller 46*a* of the tapping roller 46 is arranged opposite to the supporting roller 56*a* of the belt conveying unit 56, and the returning roller 50 is arranged opposite to the supporting roller 56*b* of the belt conveying unit 56.

In the third embodiment, a combination of the rotation roller 46*a* and the supporting roller 56*a* corresponds to the configuration for ejecting paper by the the paper ejection roller 62 and the driven roller 64 as illustrated in FIG. 1.

On the inner side of the endless belt 56*c* of the belt conveying unit 56, a reflective sheet detection sensor 70 as a sheet detecting unit that detects a sheet is arranged between the rotation roller 46*a* and the returning roller 50.

In a supporting portion of the returning roller 50, a deflection detecting unit 72 that detects deflection of a sheet is arranged. The deflection detecting unit 72 includes a contact, one end of which is supported and which is rotatable in a vertical direction, and includes a detection sensor that detects a rotation angle of the contact. In the third embodiment, a predetermined amount of deflection (height of deflection) of a sheet is detected.

A leading end of a first sheet 66*a* conveyed onto the staple tray 44 by the intermediate conveying roller pair 40 is nipped between the rotation roller 46*a* of the tapping roller 46 and the belt 56*c*, and the sheet 66*a* is conveyed to the paper ejection tray 60 side by the rotation roller 46*a* rotating clockwise.

The tapping roller 46 can be separated from the opposing supporting roller 56*a*, and can change a conveying force of the rotation roller 46*a* by changing a contact pressure of the rotation roller 46*a* against the supporting roller 56*a*.

Figure 9B:
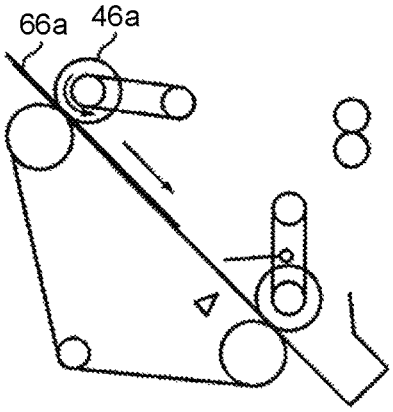

When the sheet 66*a* is conveyed by a predetermined distance to the paper ejection tray 60 side by the rotation roller 46*a*, as illustrated in FIG. 9B, the rotation roller 46*a* rotates in a reverse direction to convey the sheet 66*a* toward the rear end stopper 48.

The above-described predetermined distance is different for each sheet size, and is set to a time (distance) from when the rear end of the sheet 66*a* passes through the nip of the intermediate conveying roller pair 40 (a time at which the intermediate conveying sensor 42 detects the rear end) to when the rear end of the sheet 66*a* remains between the nip of the rotation roller 46*a*.

If productivity is taken into account, it is desirable to set the predetermined distance to a value close to a distance at which the rear end of the sheet 66*a* passes through the nip of the intermediate conveying roller pair 40.

Figure 9C:
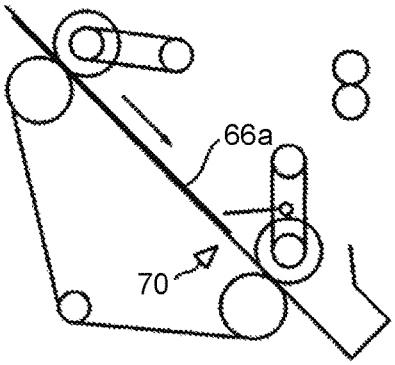

When the sheet 66*a* is conveyed by the rotation roller 46*a*, the sheet detection sensor 70 detects the rear end of the sheet 66*a* (FIG. 9C). When the sheet 66*a* is further conveyed, the rear end of the sheet 66*a* butts against the nip of the returning roller 50, the rotation of which is stopped, and a rear end portion of the sheet 66*a* is deflected.

Figure 9D:
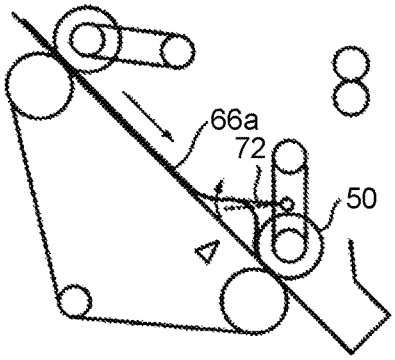

When the deflection detecting unit 72 detects a predetermined amount of deflection, the rotation roller 46*a* stops and the sheet conveyance is stopped, so that the sheet can be stopped such that the position of the rear end of the sheet is accurately located at a nip position of the returning roller 50, without the influence of fluctuation in the sheet conveyance or damage on the sheet depending on each paper type, each paper, or a difference in the environment or the like (FIG. 9D).

If a detection height to be detected by the deflection detecting unit 72 is too low, error detection may occur when a large number of papers are set on the staple tray. In contrast, if the detection height is too high, paper may be damaged due to deflection. Therefore, it is desirable to set the detection height of the deflection detecting unit 72 in a range in which error detection does not occur even when a large number of papers are set and in which paper is not damaged due to deflection.

A time from when the sheet detection sensor 70 detects the rear end of the sheet to when the deflection detecting unit 72 detects occurrence of a predetermined amount of deflection on the sheet is measured (determined).

Assuming that a measured time is denoted by t and predetermined values $t_1$ and $t_2$ have a relationship such that $t_1<t_2$, it is determined that the sheet 66*a* is thin paper when a paper thickness is such that $t<t_1$, plain paper when the paper thickness is such that $t_1 \leq t<t_2$, and thick paper when the paper thickness is such that $t_2 \leq t$.

Subsequently, the conveying force of the rotation roller 46*a* with respect to the sheet conveyed to the staple tray 44 by the intermediate conveying roller pair 40 is adjusted such that the conveying force is reduced when the sheet is thin paper and increased when the sheet is thick paper, so that it becomes possible to switch to optimal control, such as control to prevent damage on the thin paper or control to prevent a sheet feed failure of the thick paper, without input of paper information from a user.

In the third embodiment, the control is switched by using the two predetermined values $t_1$ and $t_2$. However, the number of the predetermined values $t_0$ for switching the control may be one or three or more.

When the deflection detecting unit 72 detects occurrence of a predetermined amount of deflection of the sheet 66*a*, the rotation roller 46*a* of the tapping roller 46 stops conveyance and is separated from the supporting roller 56*a*.

Figure 9E:
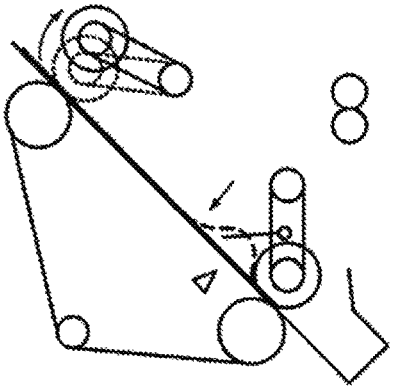

When the rotation roller 46*a* is separated, a press of one side of the deflected sheet 66*a* is released and the deflection is returned because of the hardness of the sheet 66*a* (FIG. 9E).

Figure 9F:
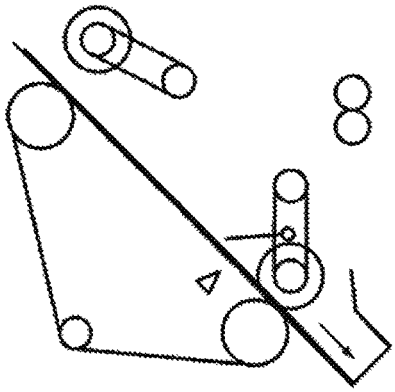

After the rotation roller 46*a* is separated, the returning roller 50 conveys the sheet 66*a* and causes the sheet 66*a* to butt against the rear end stopper 48 serving as a reference fence (FIG. 9F).

Because of the deflection generated as illustrated in FIG. 9D, the rear end of the sheet 66*a* is accurately stopped at the nip position of the returning roller 50. Therefore, it is possible to accurately align the sheet with respect to the rear end stopper 48.

Figure 10A:
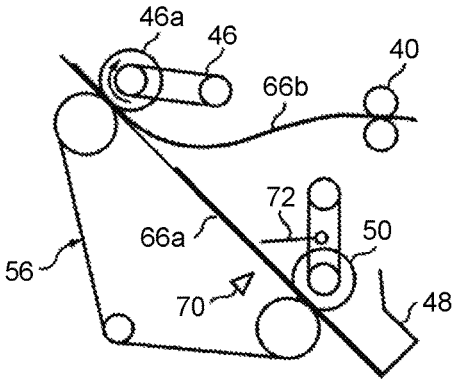
FIGS. 10A and 10B are diagrams illustrating the deflection detection operation and the rear end alignment operation on a second sheet according to the third embodiment.
Figure 10B:
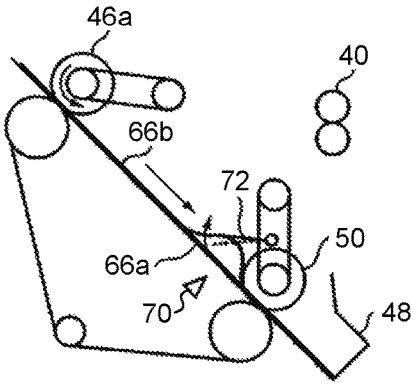

FIGS. 10A and 10B illustrate a stack operation of a second sheet 66*b*.

A conveying force (the rotation speed b after stacking) of the rotation roller 46*a* of the tapping roller 46 is adjusted to an optimal value in accordance with the paper thickness calculated for the first sheet 66*a*.

When the sheet 66*b* is conveyed by a predetermined distance by the rotation roller 46*a* as illustrated in FIG. 10A, the rotation roller 46*a* rotates in a reverse direction and conveys the sheet 66*b* toward the rear end stopper 48 as illustrated in FIG. 10B.

Similarly to the first sheet, when the sheet 66*b* is conveyed by the rotation roller 46*a*, the rear end of the sheet 66*b* butts against the nip of the returning roller 50, the rotation of which is stopped, and a rear end portion of the sheet 66*b* is deflected. When the deflection detecting unit 72 detects a predetermined amount of deflection, the rotation roller 46*a* stops and the conveyance of the sheet 66*b* is stopped.

The rear ends of the second and subsequent sheets to be subjected to the binding process are also accurately stopped at the nip position of the returning roller 50. Therefore, it is possible to accurately align the sheets with respect to the rear end stopper 48.

If paper, such as plain paper or thick paper, that has certain hardness and is less likely to be damaged when butted against the nip of the returning roller 50 is fed, it may be possible to increase the conveying speed (rotation speed) of the rotation roller 46*a* to improve the productivity.

Figure 11A:
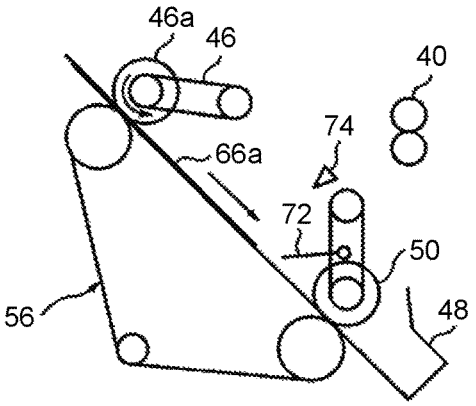
FIGS. 11A to 11C are diagrams illustrating a deflection detection operation and a rear end alignment operation according to a fourth embodiment of the present invention.
Figure 11B:
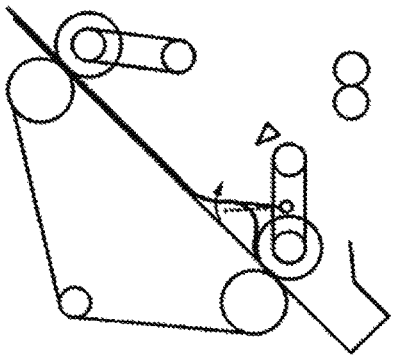
Figure 11C:
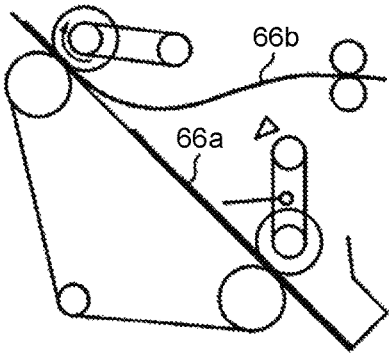

FIGS. 11A to 11C illustrate a fourth embodiment of the present invention.

In the third embodiment, the sheet detection sensor 70 is arranged below the stacking surface of the staple tray 44, and therefore, it is difficult to detect the rear ends of the second and subsequent sheets. In this case, the rotation speed of the rotation roller 46*a* is adjusted based on a detection result of the amount of deflection of the first sheet, and the rotation speed is maintained constant in a single job.

In the fourth embodiment, as illustrated in FIGS. 11A, 11B, and 11C, a sheet detection sensor 74 is arranged above the stacking surface of the staple tray 44 in order to detect the amount of deflection for each sheet.

Even for the second sheet 66*b* and subsequent sheet, a time from when the sheet detection sensor 74 detects the rear end of the sheet to when the deflection detecting unit 72 detects a predetermined amount of deflection is measured, and the conveying force and the conveying speed of the rotation roller 46*a* are optimized.

As illustrated in FIG. 11A, when the first sheet 66*a* is conveyed toward the rear end stopper 48 by the rotation roller 46*a*, the sheet detection sensor 74 detects the rear end of the sheet 66*a*. The conveying force and the conveying speed of the rotation roller 46*a* are adjusted to optimal values in accordance with a paper thickness calculated for the first sheet 66*a*.

If the sheet detection sensor 74 is a transmissive paper detection sensor, it is only possible to detect presence or absence of a sheet, and it is difficult to accurately detect the rear ends of the second sheet 66*b* and subsequent sheet. Therefore, in the fourth embodiment, a sensor, such as an ultrasonic sensor, that can detect the rear end of paper from a change in the thickness is used as the sheet detection sensor 74.

When the sheet 66*a* is conveyed by the rotation roller 46*a*, the rear end of the sheet 66*a* butts against the nip of the returning roller 50, the rotation of which is stopped, and a rear end portion of the sheet 66*a* is deflected. When the deflection detecting unit 72 detects a predetermined amount of deflection, the rotation roller 46*a* stops and the conveyance of the sheet 66*a* is stopped, so that the sheet can be stopped such that the position of the rear end of the sheet is accurately located at the nip position of the returning roller 50, without the influence of fluctuation in the sheet conveyance or damage on the sheet depending on each paper type, each paper, or a difference in the environment or the like (FIG. 11B). This operation for accurate alignment of the rear end of the sheet is similarly performed to the second sheet 66*b* that is conveyed next as illustrated in FIG. 11C.

A time from when the sheet detection sensor 74 detects the rear end of the sheet to when the deflection detecting unit 72 detects occurrence of a predetermined amount of deflection is measured. Assuming that a measured time of the first sheet 66*a* is denoted by $t_1$, a measured time of the second sheet 66*b* is denoted by $t_2$, . . . , and predetermined values $s_1$ and $s_2$ have a relationship such that $s_1<s_2$, it is determined that paper is thin paper when a paper thickness is such that $(t_1+t_2+\ldots t_n)/n<s_1$, plain paper when the paper thickness is such that $s_1\leq(t_1+t_2+\ldots t_n)/n<s_2$, and thick paper when the paper thickness is such that $s_2\leq(t_1+t_2+\ldots t_n)/n$.

Subsequently, the conveying force of the returning roller 50 with respect to the sheet conveyed toward the rear end stopper 48 by the rotation roller 46*a* is adjusted such that the conveying force is reduced when the paper is thin paper and increased when the paper is thick paper, so that it becomes possible to prevent erroneous detection of the paper thickness due to sudden fluctuation in the measured time $t_n$.

Consequently, it becomes possible to switch to optimal control, such as control to prevent damage on the thin paper or control to prevent a sheet feed failure of the thick paper, without input of paper information from a user.

Furthermore, if paper, such as plain paper or thick paper, that has certain hardness and is less likely to be damaged when butted against the nip of the returning roller 50 is fed, it may be possible to increase the conveying speed of the rotation roller 46*a* to improve the productivity.

In the fourth embodiment, the control is switched by using the two predetermined values $s_1$ and $s_2$. However, the number of the predetermined values $s_n$ for switching the control may be one or three or more. Moreover, it may be possible to use a method of determining a threshold for the value $t_n$ in each case, without using the value s.

Figure 12A:
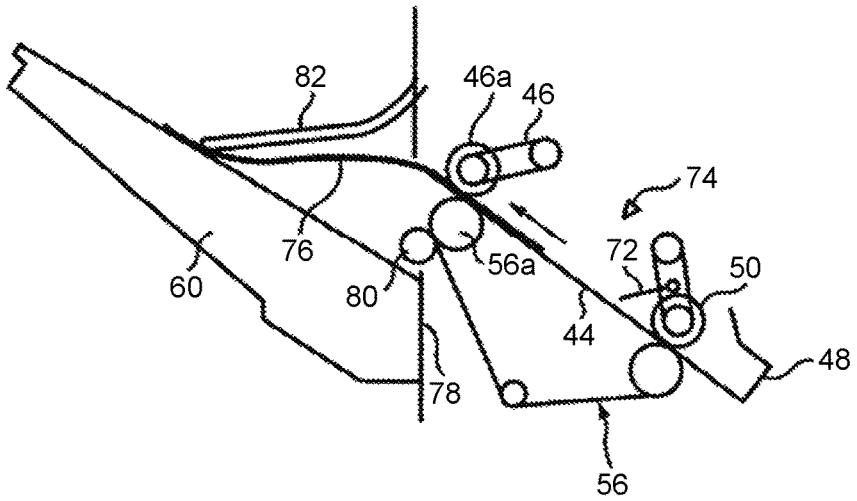
FIGS. 12A and 12B are diagrams illustrating discharge to a paper ejection tray and a rear end alignment operation on the paper ejection tray according to a fifth embodiment of the present invention.
Figure 12B:
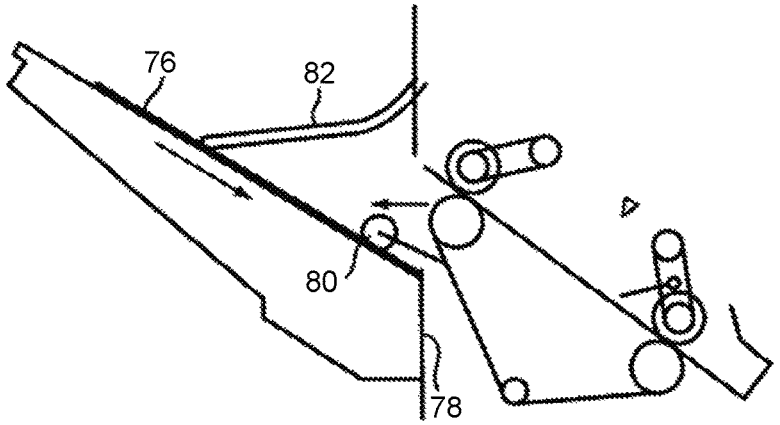

FIGS. 12A and 12B illustrate a fifth embodiment of the present invention.

A feature of the fifth embodiment is in that paper type information, which is determined based on a time taken to detect a predetermined amount of deflection on the staple tray 44, is used to optimize a conveying force of a returning member for stacking a sheet on the paper ejection tray 60.

As illustrated in FIG. 12A, a returning roller 80 as a returning member, which returns a sheet bundle 76 discharged on the paper ejection tray 60 to the upstream side in a discharging direction and causes the sheet bundle 76 to butt against an end fence 78, is provided below the supporting roller 56*a*, that is a driving roller, so as to move back and force. A reference sign 82 denotes a paper surface detection sensor that detects a height of the sheet bundle 76 discharged on the paper ejection tray 60. The paper ejection tray 60 is moved up and down based on detection information obtained by the paper surface detection sensor 82.

The sheet bundle 76 is discharged on the paper ejection tray 60 by the rotation roller 46*a* and the belt conveying unit 56. The conveying force of the rotation roller 46*a* is adjusted to an optimal value in accordance with a paper thickness calculated through deflection detection on the staple tray 44.

As illustrated in FIG. 12B, the sheet bundle 76 discharged on the paper ejection tray 60 is caused to butted against the end fence 78 by the returning roller 80, and aligned in the discharging direction.

The returning roller 80 can change the conveying force by changing a contact pressure against the paper surface, and the conveying force thereof is adjusted to an optimal value in accordance with a paper thickness calculated on the staple tray 44. For example, by reducing the conveying force in the case of thin paper and increasing the conveying force in the case of thick paper, it is possible to align sheets while maintaining the paper quality.

An operation performed after a sheet butts against the rear end stopper 48 in each of the above-described embodiments will be described below.

Figure 13:
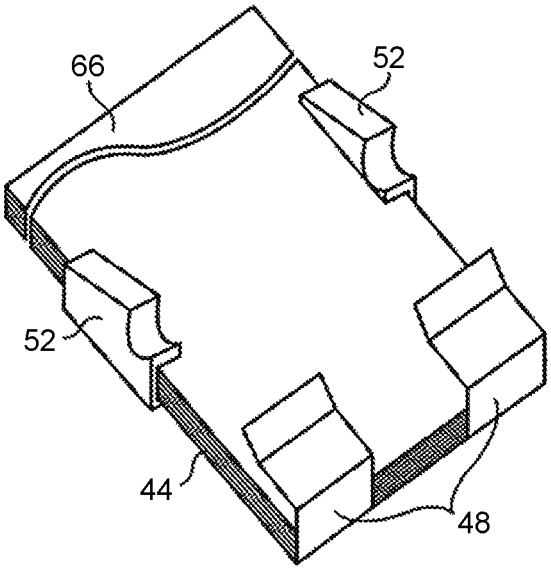
FIG. 13 is a perspective view illustrating a sheet bundle aligned on the staple tray.

FIG. 13 illustrates a state in which the sheets 66 are stacked in an aligned manner on the staple tray 44.

Figure 14:
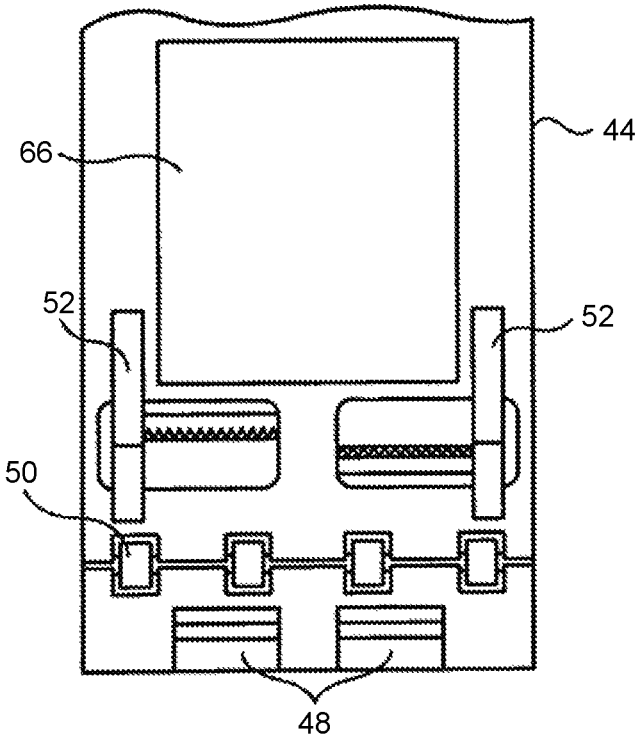
FIG. 14 is a plan view illustrating an initial state of the rear end alignment operation of on a first sheet on the staple tray.

As illustrated in FIG. 14, the jogger fences 52 arranged on left and right sides of the staple tray 44 are moved in the sheet width direction perpendicular to the sheet conveying direction, by a rack and pinion mechanism.

Figure 15A:
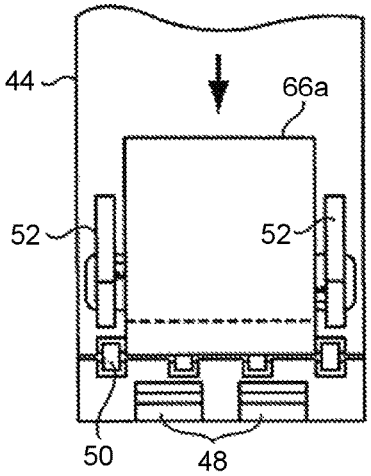
FIGS. 15A to 15E are diagrams illustrating the rear end alignment operation and a lateral alignment operation performed by jogger fences.
Figure 15B:
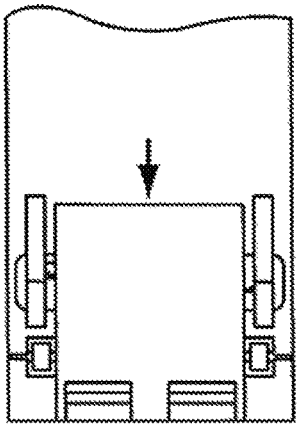
Figure 15C:
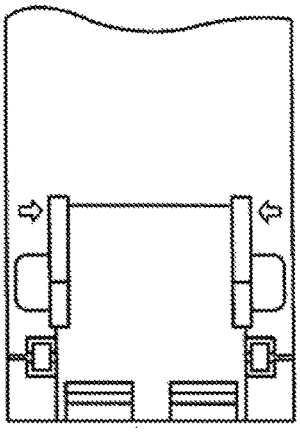

As illustrated in FIG. 15A, after the first sheet 66*a* conveyed to the staple tray 44 is deflected by a portion of the returning roller 50, the rear end of the sheet 66*a* is butted against the rear end stopper 48 by the returning roller 50 (FIG. 15B). Subsequently, the jogger fences 52 move so as to come closer to each other in a width direction of the sheet 66*a* and align the sheet in the width direction (FIG. 15C).

As described above, at the stage illustrated in FIG. 15A, a time from when the sheet detection sensor 70 detects the leading end of the sheet 66*a* to when the deflection detecting unit 72 detects occurrence of a predetermined amount of deflection is measured, and a thickness of the sheet 66*a* is determined based on the measured time t.

The moving speed of the jogger fences 52 is increased in the case of thick paper to improve the productivity, and the moving speed of the jogger fences 52 is decreased in the case of thin paper.

By doing so, it is possible to reduce damage due to the contact of the jogger fences 52 with the sheet 66*a*, and prevent reduction in the paper quality.

Figure 15D:
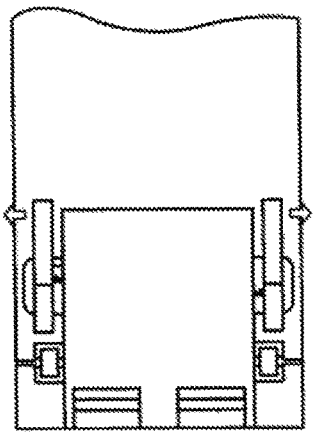
Figure 15E:
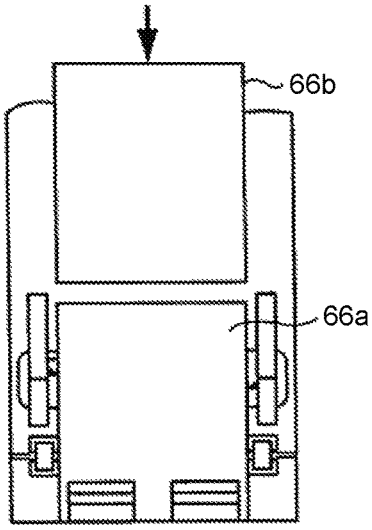

As illustrated in FIG. 15D, when alignment in the sheet width direction is finished, the jogger fences 52 are moved away, and the same operation is repeated for the subsequent sheets 66*b* (FIG. 15E).

A punching operation performed by the punching unit 16 will be described based on FIGS. 16A to 16D.

Figure 16A:
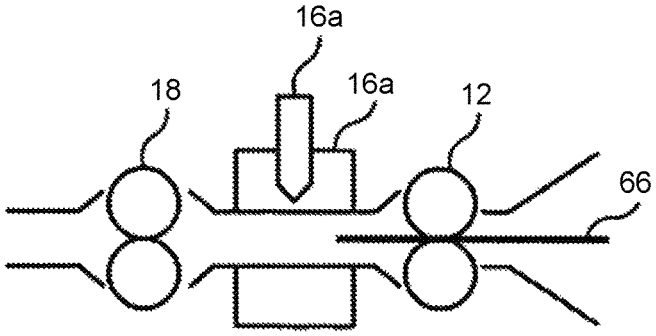
FIGS. 16A to 16D are diagrams illustrating a punching operation performed by a punching unit.
Figure 16B:
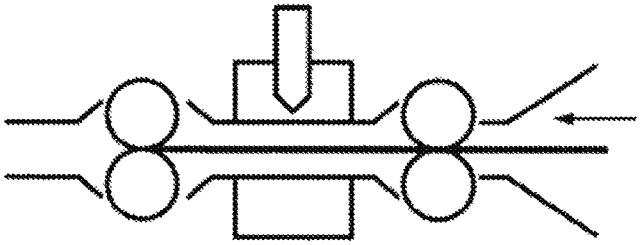

As illustrated in FIG. 16A, the sheet 66, on which an image is formed by the image forming apparatus 4, is conveyed to the sheet post-processing apparatus 6 by the entrance roller pair 12. As illustrated in FIG. 16B, the sheet 66 stops while the leading end of the sheet 66 is sandwiched by the conveying roller pair 18.

Figure 16C:
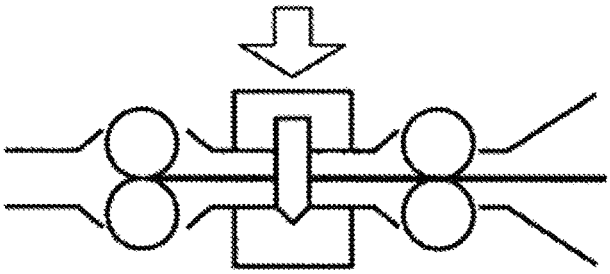

As illustrated in FIG. 16C, a punching pin 16*a* of the punching unit 16 is moved downward while the sheet 66 is stopped, and a hole is punched in the sheet 66.

A force (velocity) at the time of punching is adjusted based on information on a paper thickness obtained through the above-described deflection detection. In general, a large sound occurs when a punching force is large. However, by reducing the force with respect to thin paper for which the punching force is not needed, it is possible to reduce the sound at the time of punching.

Figure 16D:
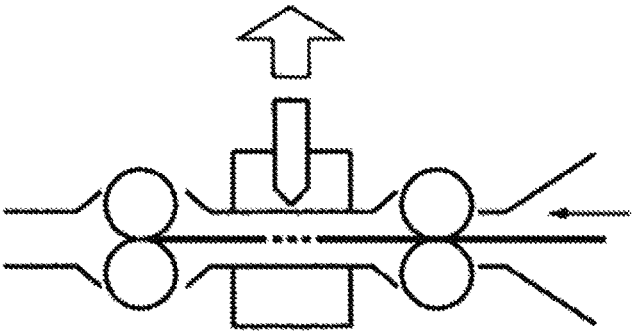

As illustrated in FIG. 16D, the punching pin 16*a* is moved away after punching, and conveyance of the sheet 66 toward the staple tray 44 is started.

In the above-described embodiments, a change in the conveying force of the rotation roller 46*a* or the returning roller 50 according to the condition, such as the paper thickness, is described as a change in the rotation speed. However, this may be realized by changing a contact pressure between the rotation roller 46*a* or the returning roller 50 and an opposing member.

While the preferred embodiments of the present invention have been explained above, the present invention is not limited to the specific embodiments, and various modifications and changes may be made within the scope of the appended claims unless otherwise specified in this document.

The effects described in relation to the embodiments of the present invention are examples of the most preferred effects, and not limited to those described in the embodiments.

According to the embodiments of the present invention, it is possible to provide a sheet post-processing apparatus capable of stabilizing a landing state of a sheet on a stack tray, and contributing to sheet alignment accuracy and post-processing accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus comprising:

a stack tray configured to stack a sheet thereon;

a rear-end-position regulating member, against which a rear end of the sheet stacked on the stack tray is butted, the rear-end-position regulating member being configured to align a position of the sheet in a conveying direction, the rear end of the sheet being a rear end in the conveying direction;

a roller member configured to, contact an upper surface of the sheet, if the sheet is conveyed to an upper side of the stack tray, before the sheet is stacked on a stacking surface on the stack tray, and convey the sheet stacked on the stacking surface toward the rear-end-position regulating member; and a deflection detector configured to detect deflection of a sheet caused by conveyance by the roller member.

2. The sheet post-processing apparatus according to claim 1, further comprising:

a butting member that is configured to move into contact with or away from the stacking surface, rotate to convey a sheet conveyed toward the rear-end-position regulating member by the roller member, and cause the sheet to butt against the rear-end-position regulating member;

a sheet detector arranged between the roller member and the butting member and configured to detect the sheet.

3. The sheet post-processing apparatus according to claim 2, further comprising:

a paper ejection tray configured to stack a sheet discharged from the stack tray; and a returning member configured to rotate to return a sheet discharged on the paper ejection tray to an upstream side in a discharging direction.

4. An image forming system comprising:

an image forming apparatus that forms an image on a sheet based on image information; and a sheet post-processing apparatus, the sheet post-processing apparatus including a stack tray configured to stack the sheet thereon, a rear-end-position regulating member, against which a rear end of the sheet stacked on the stack tray is butted to align a position of the sheet in a conveying direction, the rear end of the sheet being a rear end in the conveying direction, and a roller member configured to contact an upper surface of the sheet, if the sheet is conveyed to an upper side of the stack tray, before the sheet is stacked on a stacking surface on the stack tray, convey the sheet stacked on the stacking surface toward the rear-end-position regulating member; and a deflection detector configured to detect deflection of a sheet caused by conveyance by the roller member.

5. A method of operating a sheet post-processing apparatus, the sheet post processing apparatus including a stack tray configured to stack a sheet thereon, a rear-end-position regulating member, against which a rear end of the sheet stacked on the stack tray is butted, the rear-end-position regulating member being configured to align a position of the sheet in a conveying direction, the rear end of the sheet being a rear end in the conveying direction, and a roller member configured to, contact an upper surface of the sheet, if the sheet is conveyed to an upper side of the stack tray, before the sheet is stacked on a stacking surface on the stack tray and convey the sheet stacked on the stacking surface toward the rear-end-position regulating member, the method comprising:

rotating the roller member at a first rotation speed while the roller member is in contact with the sheet before the rear end of the sheet lands on the stacking surface, the first rotation speed being less than a second rotation speed, the first rotation speed being greater than zero; and rotating the roller member at the second rotation speed when the roller member conveys the sheet to the rear-end-position regulating member while the sheet is on the stacking surface.

6. The method according to claim 5, further comprising:

moving the roller member into contact with the sheet while the roller member is in a non-rotating state, wherein the rotating the roller member at the first rotation speed begins a time t1 before the roller member contacts the stacking surface via the sheet.

7. The method according to claim 6, wherein the rotating the roller member at the second rotation begins a time t2 after the contact of the roller member with the stacking surface via the sheet.

8. The method according to claim 7, further comprising:

rotating by the roller member at a third rotation speed during a time t3 before the end of the time t2, the third rotation speed being higher than the first rotation speed and lower than the second rotation speed.

9. The method according to claim 8, further comprising:

changing one of the time t1, the time t2, and the time t3 based on a number of stacked sheets.

10. The method according to claim 8, further comprising:

changing one of the time t1, the time t2, and the time t3 based on a sheet type.

11. The method according to claim 8, further comprising:

detecting, by a stack height detector, a height of a stack of sheets on the stack tray; and changing one of the time t1, the time t2, and the time t3 based on detection information obtained from the stack height detector, wherein the sheet post-processing apparatus includes the stack height detector.

12. The method according to claim 7, further comprising:

changing one of the time t1 and the time t2 based on a number of stacked sheets.

13. The method according to claim 7, further comprising:

changing one of the time t1 and the time t2 based on a sheet type.

14. The method according to claim 7, further comprising:

detecting, by a stack height detector, a height of a stack of sheets on the stack tray; and changing one of the time t1, and the time t2 based on detection information obtained from the stack height detector, wherein the sheet post-processing apparatus includes the stack height detector.

15. The method according to claim 6, further comprising:

changing the time t1 based on a number of stacked sheets.

16. The method according to claim 6, further comprising:

changing the time t1 based on a sheet type.

17. The method according to claim 6, further comprising:

detecting, by a stack height detector, a height of a stack of sheets on the stack tray; and changing the time t1, based on detection information obtained from the stack height detector, wherein the sheet post-processing apparatus includes the stack height detector.

18. The method according to claim 5, wherein changing at least one of the first rotation speed and the second rotation speed based on a sheet type.

* * * * *